US007628846B2

(12) United States Patent
Oh et al.

(10) Patent No.: US 7,628,846 B2
(45) Date of Patent: Dec. 8, 2009

(54) VACUUM CLEANER

(75) Inventors: Jang-keun Oh, Gwangju (KR); Seung-yong Cha, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 12/151,878

(22) Filed: May 9, 2008

(65) Prior Publication Data

US 2009/0114098 A1 May 7, 2009

Related U.S. Application Data

(60) Provisional application No. 61/001,907, filed on Nov. 5, 2007.

(30) Foreign Application Priority Data

Jan. 2, 2008 (KR) ..... 2008-404

(51) Int. Cl.
*B01D 39/00* (2006.01)

(52) U.S. Cl. ..... 96/222; 55/DIG. 3; 55/490; 55/417; 55/467; 96/403; 422/124

(58) Field of Classification Search ..... 55/DIG. 3, 55/490, 495, 417, 467; 96/222, 223; 261/DIG. 88; 422/4, 5, 122, 123, 124
See application file for complete search history.

(56) References Cited

U.S. PATENT DOCUMENTS 5,185,903 A * 2/1993 Choi ..... 15/339
6,171,375 B1 * 1/2001 Howie ..... 96/17
7,093,773 B2 * 8/2006 Kuiper ..... 239/57
2005/0138763 A1 * 6/2005 Tanner et al. ..... 15/353
2007/0209144 A1 * 9/2007 Fester et al. ..... 15/339
2007/0209147 A1 * 9/2007 Krebs et al. ..... 15/347
2008/0010958 A1 * 1/2008 Fester et al. ..... 55/472
2008/0047091 A1 * 2/2008 Nguyen ..... 15/300.1

FOREIGN PATENT DOCUMENTS

DE 4204553 8/1993

(Continued)

OTHER PUBLICATIONS

British Combined Search and Examination Report dated Dec. 12, 2008 corresponding to Application No. GB0815003.9.

*Primary Examiner*—Duane S Smith
*Assistant Examiner*—Sonji Turner
(74) *Attorney, Agent, or Firm*—Ohlandt, Greeley, Ruggiero & Perle, L.L.P.

(57) ABSTRACT

A vacuum cleaner is provided that includes a main cleaner body comprising a discharge grill to discharge air from which dust has been separated; a grill cover mounted on the discharge grill to pivot between a closed position and an open position in relation to the discharge grill; a fragrant odor generating apparatus including a first shutter and second shutter that are mounted on the grill cover and that are opened by discharge pressure of air discharged through the discharge grill and closed by their own weight, and a fragrant agent disposed in an air path between the first shutter and second shutter; and a shutter locking unit to lock the first shutter in a closed position when the cleaner is not in use.

8 Claims, 4 Drawing Sheets

FOREIGN PATENT DOCUMENTS

| | | | |
|---|---|---|---|
| GB | 2091546 | * | 1/1982 |
| JP | 2008036111 | | 2/2008 |
| KR | 100232536 | | 9/1999 |
| KR | 20-0342597 | | 2/2004 |
| SU | 1440487 | * | 1/1987 |
| WO | WO2004/107947 | | 12/2004 |

* cited by examiner

VACUUM CLEANER

CROSS-REFERENCE TO RELATED APPLICATIONS

This application claims the benefit under 35 U.S.C. § 119 from U.S. Provisional Patent Application No. 61/001,907 filed on Nov. 5, 2007, in the United States Patent and Trademark Office, and from Korean Patent Application No. 10-2008-0000404 filed on Jan. 2, 2008, in the Korean Intellectual Property Office, the disclosures of which are incorporated herein by reference in their entirety.

BACKGROUND OF THE INVENTION

1. Field of the Invention

The present disclosure relates to a vacuum cleaner, and more particularly, to a vacuum cleaner for removing unpleasant odors from air discharged through a discharge grill.

2. Description of the Related Art

Vacuum cleaners generally draw in dust-laden air from a surface being cleaned, using negative pressure generated by a vacuum suction motor, and discharge air from which dust has been separated to the outside of the vacuum cleaner through a discharge grill.

Such air discharged through the discharge grill of the vacuum cleaner may contain odors generated when a carbon brush is worn or when dust or contaminants collected in a dust collecting chamber contained therein decompose, or odors produced from mold. Such odors may cause discomfort to users.

Many attempts have been made in order to solve this problem by mounting a high efficiency particulate air (HEPA) filter for filtering fine particles in a discharge grill, or by attaching an air freshener to the discharge grill and eliminate unpleasant odors in air discharged through the discharge grill.

However, a HEPA filter is expensive compared to general filters, and needs to be periodically replaced as it is unable to filter fine particles such as carbon powder after being used for a predetermined period of time. Additionally, the HEPA filter is not effective in eliminating unpleasant odors.

Furthermore, when an air freshener is mounted in a discharge grill, the air freshener is constantly discharged into the surrounding, even when the cleaner is not in use, so frequent replacement is required.

SUMMARY OF THE INVENTION

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides a vacuum cleaner having an improved structure capable of eliminating unpleasant odors arising when the vacuum cleaner is driven.

The above aspects and/or other features of the present disclosure can be substantially achieved by providing a vacuum cleaner including a main cleaner body comprising a discharge grill to discharge air from which dust is separated; a grill cover mounted on the discharge grill to pivot between a closed position and an open position in relation to the discharge grill; a fragrant odor generating apparatus including a first shutter and second shutter that are mounted on the grill cover and that are opened by discharge pressure of air discharged through the discharge grill and closed by their own weight, and a fragrant agent disposed in an air path between the first shutter and second shutter; and a shutter locking unit to lock the first shutter in a closed position when the cleaner is not in use.

The fragrant odor generating apparatus may include a fragrant agent receptacle disposed inside the grill cover and in which the first shutter is disposed on an outer side thereof, the fragrant agent receptacle having a predetermined space; an air inflow portion disposed under the fragrant agent receptacle so that the fragrant agent receptacle is ventilated by air flowing in through the air inflow portion; and an inner cover mounted facing the discharge grill to pivot between a closed position and an open position in relation to the grill cover, so that the fragrant agent receptacle and the air inflow portion are sealed, and in which the second shutter is disposed in a position facing the air inflow portion.

The first shutter may be opened outward from the grill cover, and the second shutter may be opened inward to the air inflow portion. The first shutter and the second shutter may be disposed so as not to face each other.

The fragrant agent may be phytoncide, perfume, fragrant particles, aroma oil, wood chips, and any combinations thereof.

The fragrant agent may be housed in a porous net, the size of which is substantially the same as that of the fragrant agent receptacle.

The shutter locking unit may include a first magnet mounted in the first shutter; and a second magnet mounted in the grill cover, the second magnet having a polarity opposite that of the first magnet. In this situation, the magnetic force exerted from the first magnet and second magnet may be less than the discharge pressure of air discharged through the discharge grill.

As described above, according to the exemplary embodiment of the present disclosure, the fragrant agent may be in contact with air only when the vacuum cleaner is operated, or may be cur off from the air when the vacuum cleaner is not operated, so the fragrance may be maintained for a longer period.

Additionally, the shutter locking unit may be provided so that an external shutter may be opened only when a force greater than pressure of discharged air is exerted, so it is possible to prevent the fragrant agent from being in contact with air by opening the external shutter when the cleaner falls down or is inclined.

Furthermore, the fragrant odor generating apparatus may be openably configured, so if the fragrant agent may be replaced when completely exhausted.

Other objects, advantages and salient features of the disclosure will become apparent from the following detailed description, which, taken in conjunction with the annexed drawings, discloses preferred embodiments of the disclosure.

BRIEF DESCRIPTION OF THE DRAWINGS

These and/or other aspects and advantages of the disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF EXEMPLARY EMBODIMENTS

Hereinafter, a vacuum cleaner according to an exemplary embodiment of the present disclosure will now be described in detail with reference to the accompanying drawings.

Figure 1:
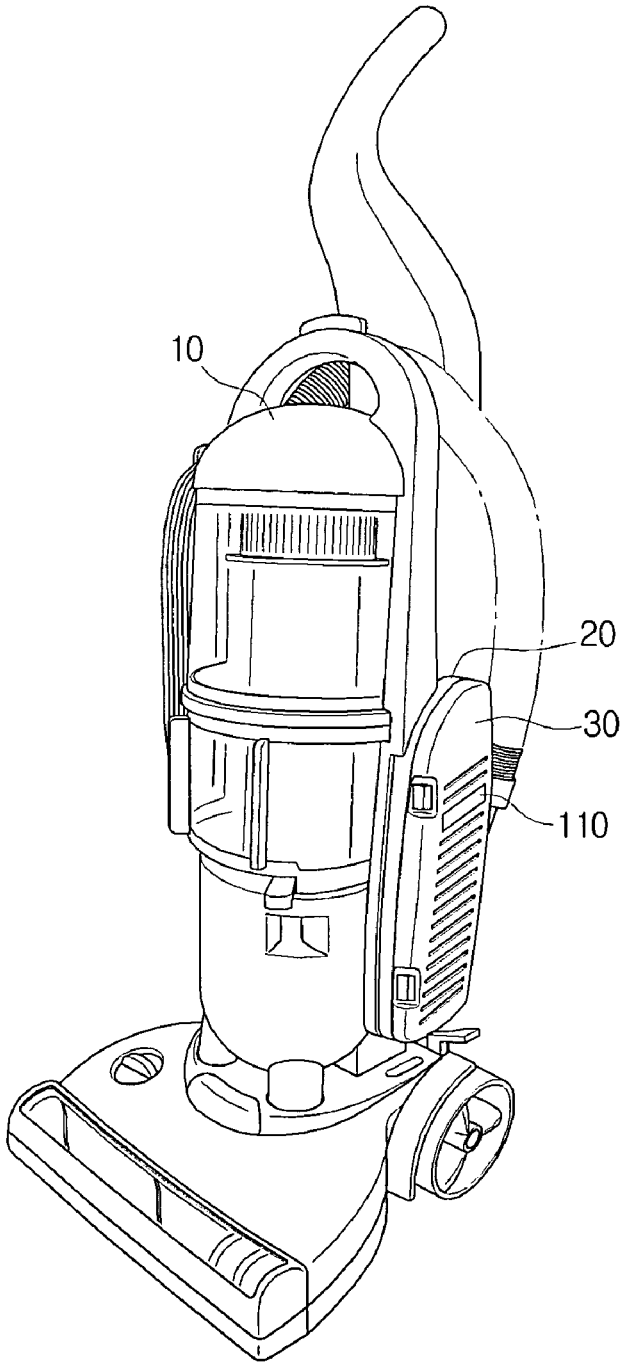
FIG. 1 is a perspective view showing an upright vacuum cleaner to which the present disclosure is applicable.
Figure 2:
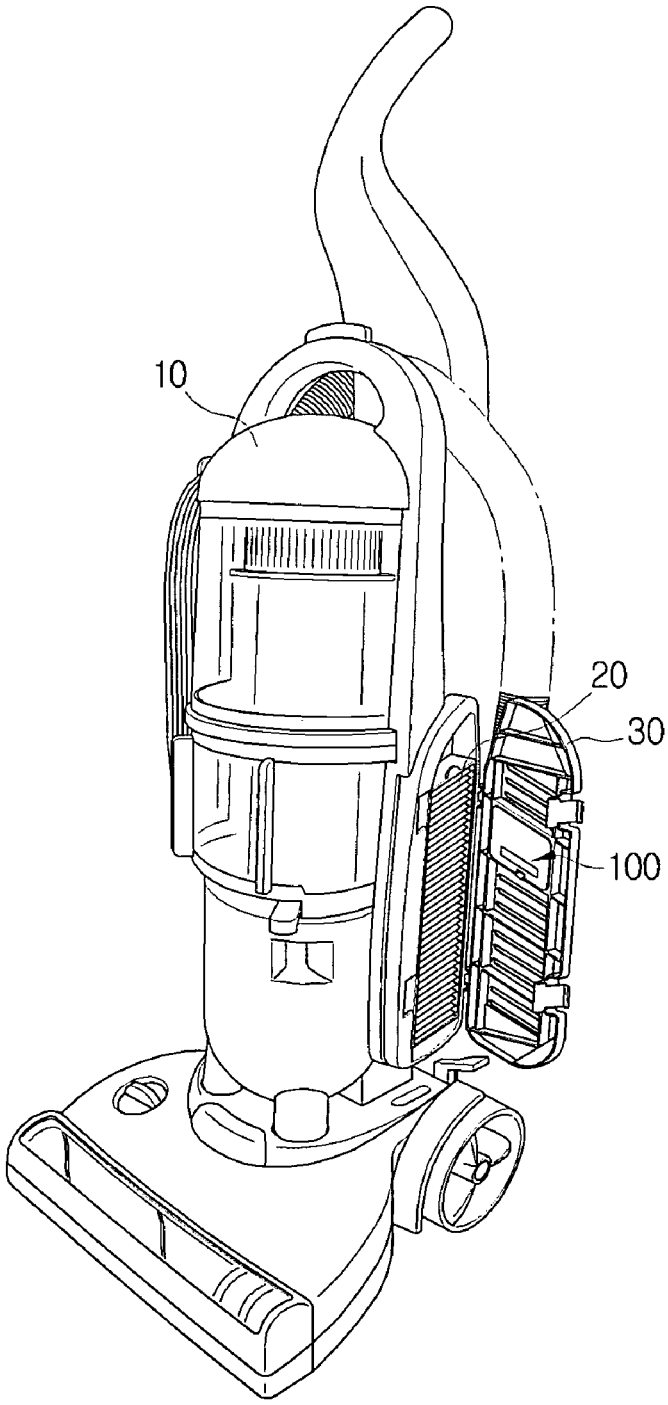
FIG. 2 is a perspective view of a grill cover of FIG. 1 in an open position.

Referring to FIGS. 1 and 2, the vacuum cleaner according to the exemplary embodiment of the present disclosure includes a main cleaner body 10, a discharge grill 20, a grill cover 30, a fragrant odor generating apparatus 100, and a shutter locking unit 200.

The main cleaner body 10 draws in dust-laden air from a surface being cleaned, using negative pressure generated by a negative pressure generating device such as a vacuum suction motor (not shown), and collects dust using a dust collector.

The discharge grill 20 discharges air from which dust has been separated and which has been filtered by the dust collector, outside the main cleaner body 10. The discharge grill 20 may include a filter to filter carbon powder generated by the vacuum suction motor or fine dust particles that have not yet been filtered by the dust collector.

The grill cover 30 is mounted on the discharge grill 20 so as to pivot between a closed position and an open position in relation to the discharge grill 20. Accordingly, the discharge grill 20 may be exposed according to user selection. The grill cover 30 may prevent the filter or the like from being exposed externally and from being polluted due to dust or dirt drawn in from outside.

The fragrant odor generating apparatus 100 is mounted inside the grill cover 30. The fragrant odor generating apparatus 100 may cause a fragrant agent to be contained in air discharged from the vacuum suction motor mounted in the main cleaner body 10, to destroy unpleasant odors in the discharged air.

Figure 5:
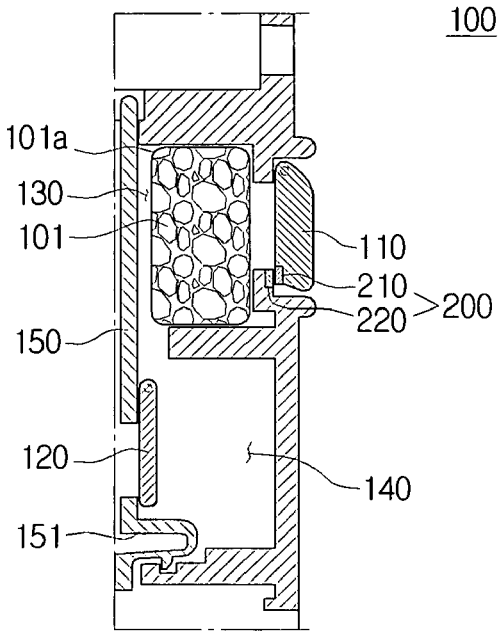
FIG. 5 is a cross-sectional view of a fragrant odor generating apparatus when the vacuum cleaner is not in use, according to an exemplary embodiment of the present disclosure is kept.

As shown in FIG. 5, the fragrant odor generating apparatus 100 includes a fragrant agent 101, a first shutter 110, a second shutter 120, a fragrant agent receptacle 130, an air inflow portion 140, and an inner cover 150.

The fragrant agent 101 may be phytoncide, perfume, fragrant particles, aroma oil, wood chips, and any combinations thereof. The fragrant agent 101 may be housed in a porous net 101*a*, the size of which is substantially the same as that of the fragrant agent receptacle 130.

Here, phytoncide is a term consisting of "phyton" meaning plant and "cide" meaning sterilizing power, and the main ingredient thereof is Terpene. Phytoncide has the effects of increasing the psychological stability, hardening peripheral blood vessels and strengthening the cardiorespiratory function, so it has received widespread attention in recent years.

Figure 6:
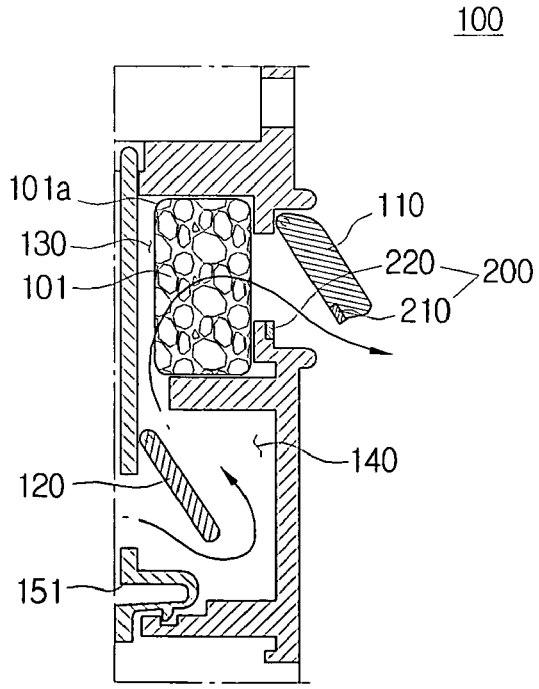
FIG. 6 is a cross-sectional view of a fragrant odor generating apparatus when the vacuum cleaner is in use, according to an exemplary embodiment of the present disclosure.

The first shutter 110 and second shutter 120 may be opened by the discharge pressure of air discharged through the discharge grill 20, and closed by their own weight. The first shutter 110 and second shutter 120 may be disposed so as not to face each other. In order to achieve this, as shown in FIGS. 5 and 6, the first shutter 110 is disposed in a position facing the fragrant agent receptacle 130, and may be opened outward from the grill cover 30 so that the fragrant agent 101 is in fluid communication with the outside of the cleaner only when the cleaner is being operated. The second shutter 120 is disposed in a position facing the air inflow portion 140, and may be opened inward to the air inflow portion 140 when the cleaner is in use.

Figure 3:
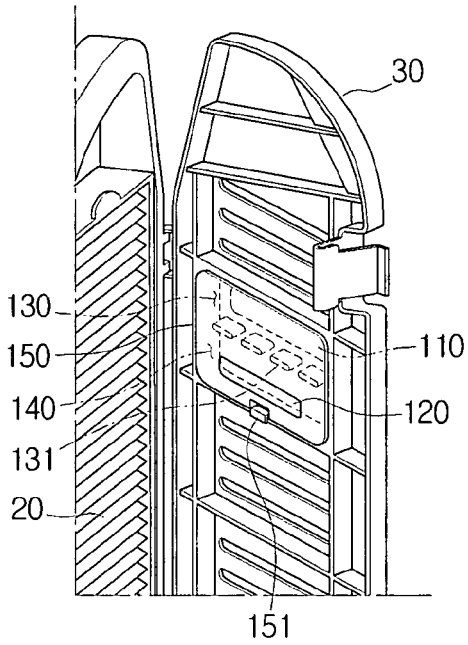
FIG. 3 is an enlarged, perspective view of the inside of the opened grill cover shown in FIG. 2.

The fragrant agent receptacle 130 is disposed inside the grill cover 30, and may desirably have a space having a predetermined volume, as shown in FIG. 3. Additionally, a plurality of support pins are disposed at regular intervals on a lower side of the fragrant agent receptacle 130, so that the fragrant agent receptacle 130 may be ventilated by air flowing in through the air inflow portion 140 disposed under the fragrant agent receptacle 130.

The air inflow portion 140 is disposed under the fragrant agent receptacle 130, and a predetermined space is formed therein so that the air discharged via the discharge grill 20 may push the second shutter 120 in the direction of the air inflow portion 140 in order to open the second shutter 120.

Figure 4:
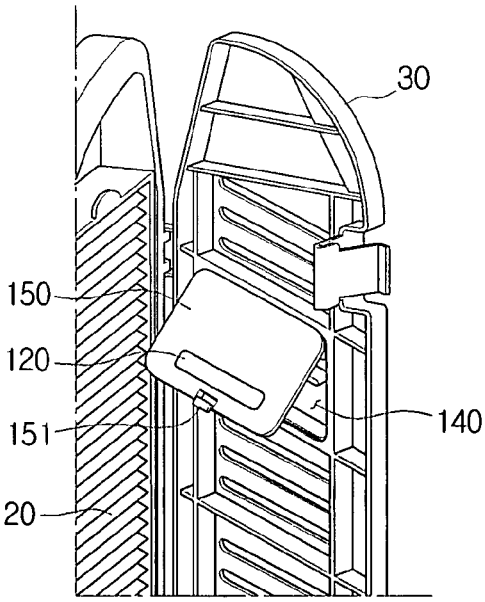
FIG. 4 is an enlarged, perspective view of an inner cover of a flagrant odor generating apparatus in an open position, according to an exemplary embodiment of the present disclosure.

The inner cover 150 is mounted inside the grill cover 30 to pivot between a closed position and an open position in relation to the grill cover 30, in order to cover the fragrant agent receptacle 130 and the air inflow portion 140. The second shutter 120 is disposed on the inner cover 150 in a position facing the air inflow portion 140, so as to be opened inward to the air inflow portion 140. Additionally, the inner cover 150 is fixed to the grill cover 30 by a cover locker 151. If the fragrant agent 101 in the fragrant agent receptacle 130 is completely exhausted and needs to be replaced, the cover locker 151 may be unfastened to open the inner cover 150, as shown in FIG. 4.

The shutter locking unit 200 may lock the first shutter 110 in a closed position when the cleaner is not in use, and may unlock the first shutter 110 when the cleaner is used. The shutter locking unit 200 includes a first magnet 210 mounted in the first shutter 110 and a second magnet 220 mounted in the grill cover 30. The first magnet 210 may be attached to the second magnet 220 by a magnetic force, which is less than the discharge pressure of the air discharged via the discharge grill 20.

Hereinafter, operations of the vacuum cleaner according to the exemplary embodiment of the present disclosure will be described in detail with reference to FIGS. 5 and 6.

When the cleaner is not in use, the first shutter 110 and second shutter 120 of the fragrant odor generating apparatus 100 are closed by their own weight. The first shutter 110 is locked by the magnetic force of the shutter locking unit 200, so even if the cleaner falls down or is inclined, the first shutter 110 is not opened by its own weight. Accordingly, the fragrant agent 101 is not in contact with external air when the cleaner is not in use, so the fragrance may be maintained for a longer period.

Alternatively, when the cleaner is in use, the air discharged from the vacuum suction motor through the discharge grill 20 may push the second shutter 120 in the direction of the air inflow portion 140 in order to open the second shutter 120. Then, the air may pass through the fragrant agent 101 housed in the fragrant agent receptacle 130 and may then be discharged to the outside of the cleaner. The shutter locking unit 200 is fastened by the magnetic force, but the magnetic force from the shutter locking unit 200 is less than the discharge pressure of the air discharged through the discharge grill 20. Accordingly, if air is discharged through the discharge grill 20, discharge air pressure may cause the magnetic force for fixing the first shutter 110 to push the first shutter 110 outward, so that the first shutter 110 may be opened.

In this situation, when the air passing through the fragrant agent 101 causes the fragrant agent 101 to sublime, unpleasant odors may be eliminated. Additionally, the fragrant agent 101 diluted with the air passing through the fragrant odor generating apparatus 100 enables the user not to notice unpleasant odors in the air discharged via the discharge grill 20.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A vacuum cleaner, comprising:

a main cleaner body comprising a discharge grill to discharge air from which dust is separated;

a grill cover mounted on the discharge grill to pivot between a closed position and an open position in relation to the discharge grill; and a fragrant odor generating apparatus, the fragrant odor generating apparatus comprising:

a first shutter and a second shutter that are mounted on the grill cover and that are opened by discharge pressure of air discharged through the discharge grill and closed by their own weight;

a fragrant agent disposed in an air path between the first shutter and second shutter; and a shutter locking unit to lock the first shutter in a closed position when the cleaner is not in use.

2. The vacuum cleaner according to claim 1, wherein the fragrant odor generating apparatus further comprises:

a fragrant agent receptacle disposed inside the grill cover and in which the first shutter is disposed on an outer side thereof, the fragrant agent receptacle having a predetermined space;

an air inflow portion disposed under the fragrant agent receptacle so that the fragrant agent receptacle is ventilated by air flowing in through the air inflow portion; and an inner cover mounted facing the discharge grill to pivot between a closed position and an open position in relation to the grill cover, so that the fragrant agent receptacle and the air inflow portion are sealed, and in which the second shutter is disposed in a position facing the air inflow portion.

3. The vacuum cleaner according to claim 2, wherein the first shutter is opened outward from the grill cover and the second shutter is opened inward to the air inflow portion.

4. The vacuum cleaner according to claim 3, wherein the first shutter and the second shutter are disposed so as not to face each other.

5. The vacuum cleaner according to claim 2, wherein the fragrant agent is selected from the group consisting of phytoncide, perfume, fragrant particles, aroma oil, wood chips, and any combinations thereof.

6. The vacuum cleaner according to claim 5, wherein the fragrant agent is housed in a porous net, the size of which is substantially the same as that of the fragrant agent receptacle.

7. The vacuum cleaner according to claim 1, wherein the shutter locking unit comprises:

a first magnet mounted in the first shutter; and a second magnet mounted in the grill cover, the second magnet having a polarity opposite that of the first magnet.

8. The vacuum cleaner according to claim 7, wherein the magnetic force exerted from the first magnet and second magnet is less than the discharge pressure of air discharged through the discharge grill.

* * * * *